United States Patent [19]

King

[11] Patent Number: 4,793,713

[45] Date of Patent: Dec. 27, 1988

[54] ROTARY MIXER

[75] Inventor: L. Tony King, Long Beach, Calif.

[73] Assignee: Komax Systems, Inc., Long Beach, Calif.

[21] Appl. No.: 34,672

[22] Filed: Apr. 6, 1987

[51] Int. Cl.[4] ..... B01F 7/12; B01F 13/00; B01F 15/02

[52] U.S. Cl. ..... 366/150; 366/325; 366/349

[58] Field of Search ..... 366/150, 154, 155, 176, 366/177, 169, 279, 295, 305, 307, 336, 337, 338, 339, 340, 325, 349, 228, 79, 293, 160, 194, 179, 292, 302, 329; 422/135, 225, 226; 241/45, 152 R, 152 A, 157, 260

[56] References Cited

U.S. PATENT DOCUMENTS

| | | | |
|---|---|---|---|
| 1,935,884 | 11/1933 | Loomis et al. | 366/302 X |
| 3,064,307 | 11/1962 | Sanborn | 366/325 X |
| 3,166,301 | 1/1965 | Wootten | 366/169 |
| 3,321,283 | 5/1967 | Ewald | 366/295 X |
| 4,169,679 | 10/1979 | Miller et al. | 366/81 X |
| 4,179,222 | 12/1979 | Strom et al. | 366/337 |
| 4,674,888 | 6/1987 | Carlson | 366/101 X |

*Primary Examiner*—Harvey C. Hornsby
*Assistant Examiner*—Scott J. Haugland
*Attorney, Agent, or Firm*—Limbach, Limbach & Sutton

[57] ABSTRACT

A mixing device for the mixing of two or more liquids. A drive motor is connected to a hollow shaft which is rotatably contained within a shell body. The hollow shaft is configured with slotted gooves for receiving liquids to be mixed from inlets located within the shell body. A narrow annular gap region is formed between the outer surface of the hollow shaft and the inner surface of the shell body in an area of the hollow shaft not occupied by the slotted grooves. A first set of holes is configured in the hollow shaft located downstream of the narrow annular gap region for the introduction of liquids into the interior of the hollow shaft and a second set of holes configured in the hollow shaft located downstream of the first set of holes for dispensing the liquids from the interior of the hollow shaft and through the shell body.

4 Claims, 1 Drawing Sheet

ROTARY MIXER

TECHNICAL FIELD OF THE INVENTION

The present invention deals with a mixing device for the mixing of two or more liquids. The device has been configured to improve the quality of mixing by maximizing the scale and intensity of mixing of the components to be mixed.

BACKGROUND OF THE INVENTION

Mixing is a term applied to actions which reduce non-uniformities of materials in bulk. Such materials can be liquids, solids or gases, and the non-uniformities in such materials can occur in various properties, such as color, density, temperature, etc. The quality of mixing can be described by two characteristics—scale ("S") and intensity ("I"). The scale of a mixture is the average distance between the centers of maximum difference in a given property of the mixture, and intensity is the variation in a given property of the mixture.

The terms "S" and "I" are easily understood by the following illustration. Assume that in a shallow dish of white paint, a number of randomly dropped dollops of viscous black paint have been applied. Where all black paint within a dollop resides, the intensity "I" is 100%. In regions of white paint the intensity is 0%. The distance between the center of a black dollop and an adjacent white region is called the scale of mixing.

If the dish of paint were allowed to sit untouched, the demarkation between black and white would begin to blur as the peak or 100% intensity of the black paint diminishes, and the 0% intensity of the white paint rises. Finally, when enough time has passed, the intensity variation will asymptote to 0, and a uniformly gray paint mixture will result. Obviously, the smaller the scale of mixing, the more rapidly will the intensity variation asymptote to 0. Conversely, the higher the molecular diffusion, the larger the scale of mixing can be in achieving a given degree of mixedness for a given time period. Generally speaking, the higher the viscosity of a fluid, the lower will be its rate of molecular diffusion in any given solvent.

As design goals in producing the mixer of the present invention, it was the intent to reduce the scale of mixing rapidly, and thus promote a rapid drop in intensity.

The principles outlined above have particular application in the mixing of special polymers which are used in water treatment applications. These polymers are usually supplied having viscosities that can range from a few thousand centipoise to the order of one million centipoise. The polymers are generally diluted on site to save shipping costs and injected and mixed with the water to be treated as they cause particulates in water to agglomerate to form what is called "floc", which can then be filtered.

Obviously, such high viscosity polymers are difficult to dilute on site. The conventional mechanical mixing approach, consisting of a motor-driven paddle or blade in a tank, is clumsy, inefficient, an ineffective. Large lumps of undiluted polymer can circulate for hours or even days without being dissolved into solution. In addition, the very high shear rates associated with the tips of the blades can damage shear-sensitive polymers by breaking up the long chain polymers and reduce the flocculation efficiency. This is particularly true for emulsion polymers.

Even though such special polymers used in water treatment applications are introduced to, for example, ten times their own volume of water, the mixture will have a much higher viscosity than the original, undiluted matter—often ten to 50 times higher. Typical dilution ratios are 200 to one. In examining this problem, it became obvious that an appropriate mixing system would be one which would break up the water/-polymer elements into very small components so as to achieve a minimum scale of mixing. It was also recognized that the appropriate mixing system should be one which could provide for controlled shearing to cause a smearing of the elements together. This aids in molecular diffusion by increasing the interfacial area and by reducing interfacial thickness. It was obviously a design goal to accomplish this result in the shortest amount of time, preferably in the order of one second or less.

It is thus an object of the present invention to achieve the above-recited results inexpensively and without undue complexity.

This and further objects will be more fully appreciated when considering the following disclosure and appended drawings, wherein FIG. 1 represents a partial cross-sectional view of the mixing device of the present invention.

SUMMARY OF THE INVENTION

The present invention deals with a device for the mixing of two or more liquids. The device comprises a drive motor connected to a hollow shaft which causes the shaft to rotate. The shaft is contained within a shell body, which in turn possesses inlets for the various liquids to be mixed therein. The inlets, located proximate one end of the shell body, introduce the liquids to be mixed into slotted grooves configured within the hollow shaft. A narrow annular gap region is formed between the outer surface of the hollow shaft and the inner diameter of the shell body in an area of the hollow shaft not occupied by the slotted grooves. A first set of holes is configured in the hollow shaft located downstream of the narrow annular gap region for the introduction of liquids into the interior of the hollow shaft and a second set of holes configured in the hollow shaft located downstream of the first set of holes for dispensing the liquids from the interior of the hollow shaft through the shell body.

In operation, the slotted grooves located in the hollow shaft capture the liquids entering the shell body. The liquids are then caused to travel down the grooves toward the annular gap region due to the hydraulic pressure imposed on the liquids at inlet.

As an optional expedient, a pump can be connected to the hollow shaft for pumping a polymer or similar liquid at an inlet to the shell body when the drive motor is activated. Further, the interior of the hollow shaft can be fitted with a plurality of mixing elements, the nature of which will be described in detail at a later point in this disclosure.

DETAILED DESCRIPTION OF THE INVENTION

Figure 1:
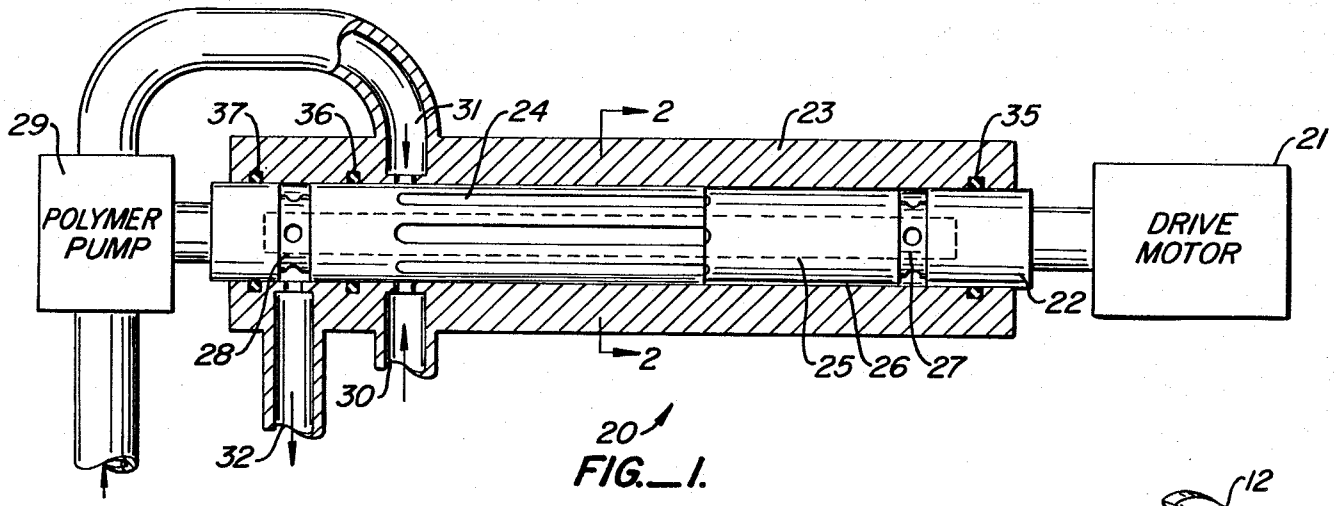

Turning first to FIG. 1, the basic mixing device of the present invention is shown as element 20. On the right is located drive motor 21, which can be of any size for driving hollow shaft 22 and optionally provided polymer pump 29. Obviously, the larger the mixing device and the more viscous the materials to be mixed, the larger the drive motor should be. For most applications, drive motors in the size range of 0.1 to 1.0 hp have been found to be adequate.

Outer shell 23, which can comprise a cast or forged metal housing, is provided with inlets 30 and 31 for introducing the liquids to be mixed. When pump 29 is provided, the viscous liquid, such as the polymer component in a polymer/water two-component system, would be introduced, employing the pump and thus the more viscous polymer component will enter the mixer via inlet 31.

As the liquids are introduced, drive motor 21 causes hollow shaft 22 to rotate and the result is the introduction of bands of the viscous component into a contiguum of the low-viscosity component into slotted grooves 24. The hydraulic pressure imposed at inlets 30 and 31 causes the liquids to progress down the slotted grooves from left to right toward region 25.

Figure 2:
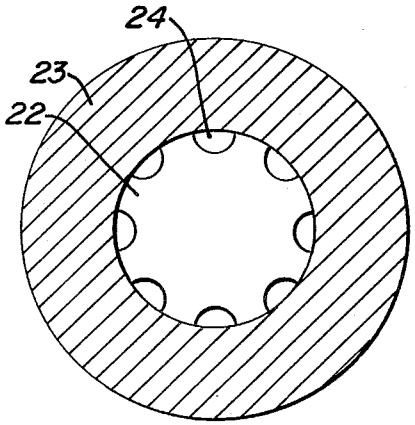
FIG. 2 represents a cross-sectional view along lines A—A of FIG. 1.

Turning to FIG. 2, a depiction of a cross-section of the mixing device of the present invention reveals the preferred shape of slotted grooves 24 in their relationship to shell body 23. It is noted that little or no clearance is provided between the outer diameter of hollow shaft 22 and the inside diameter of shell body 23. As such, virtually all of the liquids to be mixed are introduced and retained within slotted grooves 24. The slotted grooves act as channels to feed the liquids to narrow annular gap region 25.

At the termination of slotted grooves 24 is provided the narrow annular gap region 25. In this portion, the outside diameter of hollow shaft 22 has been reduced, forming gap 26 between the outside diameter of hollow shaft 22 and the inside diameter of shell body 23.

As the liquid components traveling down slotted grooves 24 enter the annular gap region 25, a smearing effect takes place as the liquids are forced to occupy gap 26 while hollow shaft 22 rotates. This smearing action greatly reduces the scale of mixing "S" of the liquids and enhances a reduction in the intensity "I" of the fluid mixture.

Hydraulic pressure imposed at inlets 30 and 31 further cause the "smeared" liquid mixture to enter a first set of holes 27 which introduces the liquids to the interior of hollow shaft 22. Once within the interior, these liquids progress to the left in the illustration of FIG. 1 until a second set of holes 28 are reached. The liquids which are, at this point, well mixed are now dispensed from the apparatus via liquid outlet port 32.

Figure 3:
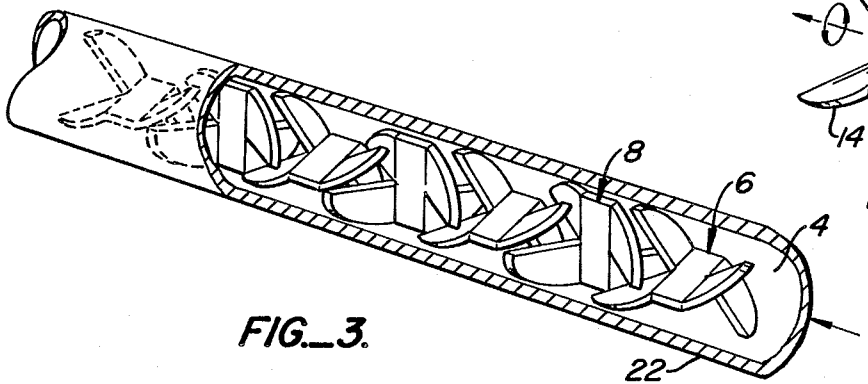
FIG. 3 is a partially cut away perspective view of the stationery material mixing apparatus which may optionally be included within the interior of the mixing device of FIG. 1.

As a further optional expedient, it is contemplated that the interior of hollow shaft 22 be fitted with a plurality of self-nesting, abutting and axially overlapping elements shown as elements 6 and 8 of FIG. 3. Mixing elements of this nature are described in Applicant's U.S. Pat. No. 3,923,288, which issued on Dec. 2, 1975, the disclosure of which is incorporated herein by reference.

Figure 4:
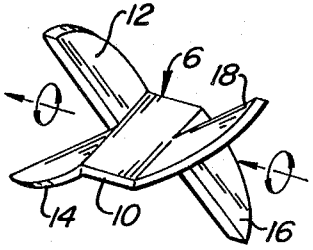
FIG. 4 is a perspective view of a single mixing element which optionally can be included within the interior of the mixing device of FIG. 1 in a nested arrangement as shown in FIG. 3.

Turning once again to FIGS. 3 and 4, the various mixing elements 6 and 8 are shown to self-align, abut and nest with adjacent elements to provide a close fit to the interior walls of hollow shaft 22 and provide a slight "spring", such that no permanent connection between the elements or between the elements and the inner wall surface of the hollow shaft is required. Each region of axial overlap between elements provides a mixing matrix in producing complex velocity vectors into the materials. A flat, axially aligned portion 10 of each element provides a "drift space" subsequent to each mixing matrix for the liquids to recombine prior to encountering the next matrix.

It is noted that element 6 includes a central flat portion 10, the plane of which is intended to be generally aligned with the longitudinal axis of hollow shaft 22. First and second ears 12 and 14, rounded or otherwise configured at their outside peripheries for a general fit to the wall of hollow shaft 22, are bent upward and downward from the flat portion 10. A second pair of ears 16 and 18 at the opposite side of flat portion 10 are bent downward and upward, respectively. The outside peripheral edges of ears 16 and 18 are also rounded or otherwise configured for a general fit to the wall of hollow shaft 22. Element 8 is a mirror image of element 6 and elements 6 and 8 are alternated throughout the interior of hollow shaft 22, the total number of elements used depending on the materials being mixed and the degree of mixing desired. Each consecutive element 6 and 8 has its flat central portion generally perpendicular to the next element.

One of the advantages in employing a mixing device of the present invention is that it is relatively easy to calculate the scale of mixing of two liquids. If n = the number of slots, assumed to be semicircular (see FIG. 2)

N = RPM of the drive motor

Q = the flow rate of water in GPM q = the flow rate of polymer in GPM d = the diameter of slots in inches then the flow rate in a single groove equals $(Q+q)/n$ gpm the velocity in the grooves equals $0.204\ (Q+q)/nd^2$ ft/second equals $2.45\ (Q+q)/nd^2$ in/second the injection time for each groove equals $1/Nn60$ sec distance between the centerpoints of the polymer and the centerpoint of the water equals $2.45\ (Q+q)/nd^2 \times 1/Nn60$ in. divided by 2 or s equals $0.02\ (Q+q)/Nn^2d^2$ inches.

In a particular test unit which was fabricated pursuant to the present invention, hollow shaft 22 was provided with 16 slotted grooves (n). The hollow shaft was rotated using a motor sized at 150 RPM (N). Water was fed to the unit at a rate of 5 GPM (Q) and polymer was fed at a rate of 0.25 GMM (q). Slotted grooves 24 were configured as semicircular profiles having diameters of 0.125 inches (d). Inserting these values into the formula presented above, we find that the scale of mixing or "S" equals $0.17 \times 10^{-3}$ inches. It was further noted that the scale of mixing is somewhat independent of the polymer flow rate for dilute solutions.

In view of the foregoing, modifications to the disclosed embodiments within the spirit of the invention will be apparent to those of ordinary skill in the art. The scope of the invention is therefore to be limited only by the appended claims.

I claim:

1. A mixing device for the mixing of two or more liquids comprising a drive motor connected to a hollow shaft such that activation of said drive motor causes said shaft to rotate, a shell body for rotatably housing said hollow shaft, said shell body having inlets for the liquids to be mixed proximate one end thereof, slotted grooves configured within the hollow shaft for receiving the liquids to be mixed from the inlets located within said shell body, a narrow annular gap region formed between the outer surface of the hollow shaft and the inner surface of the shell body in an area of the hollow shaft not occupied by said slotted grooves, a first set of holes configured in said hollow shaft for the introduction of said liquids into the interior of said hollow shaft and a second set of holes configured in the hollow shaft located downstream from said first set of holes for dispensing said liquids from the interior of the hollow shaft and through the shell body.

2. The mixing device of claim 1 wherein hydraulic pressure is imposed on the liquids at the inlets and said slotted grooves capture liquids entering said shell body, said liquids then being caused to travel down said grooves towards said annular gap region due to the hydraulic pressure imposed on the liquids.

3. The mixing device of claim 1 wherein said hollow shaft is further connected to a pump for pumping one or more of the liquids at one of the inlets to said shell body when said drive motor is activated.

4. The mixing device of claim 1 wherein the interior of said hollow shaft is fitted with a plurality of abutting, self-nesting elements, wherein adjacent elements are configured as mirror images of one another, each element having lengths along the longitudinal axis of the hollow shaft wherein adjacent elements axially overlap, defining mixing matrices inducing both counterrotating angular velocities relative to said longitudinal axis and simultaneous inward and outward radial velocities relative to said longitudinal axis on materials moving through said mixing matrices, each element having a length along the longitudinal axis where said elements do not axially overlap, the axial non-overlap lengths of said elements along the length of the longitudinal axis defining drift spaces for the recombination of said liquids subsequent to movement through the mixing matrices.

* * * * *